US007955062B2

(12) United States Patent
Mathers

(10) Patent No.: US 7,955,062 B2
(45) Date of Patent: Jun. 7, 2011

(54) VANE PUMP

(76) Inventor: Norman Ian Mathers, Bridgeman Downs (AU)

( * ) Notice: Subject to any disclaimer, the term of this patent is extended or adjusted under 35 U.S.C. 154(b) by 634 days.

(21) Appl. No.: 11/914,203

(22) PCT Filed: May 12, 2006

(86) PCT No.: PCT/AU2006/000623

§ 371 (c)(1),
(2), (4) Date: Jul. 1, 2008

(87) PCT Pub. No.: WO2006/119574

PCT Pub. Date: Nov. 16, 2006

(65) Prior Publication Data

US 2008/0310988 A1 Dec. 18, 2008

(30) Foreign Application Priority Data

May 12, 2005 (AU) ..... 2005902406

(51) Int. Cl.
*F04C 2/344* (2006.01)
*F04C 28/18* (2006.01)

(52) U.S. Cl. ..... 418/23; 418/24; 418/26; 418/268; 417/213

(58) Field of Classification Search ..... 418/16, 418/23, 24, 26, 104, 268; 417/213
See application file for complete search history.

(56) References Cited

U.S. PATENT DOCUMENTS

| | | | | |
|---|---|---|---|---|
| 3,421,413 | A * | 1/1969 | Adams et al. | 418/268 |
| 3,586,466 | A | 6/1971 | Erickson | 418/80 |
| 4,260,343 | A | 4/1981 | Watanabe et al. | 418/269 |
| 5,509,793 | A | 4/1996 | Cherry et al. | 418/219 |
| 6,015,278 | A | 1/2000 | Key et al. | 418/82 |
| 6,634,865 | B2 * | 10/2003 | Dalton | 418/268 |
| 7,070,399 | B2 * | 7/2006 | Konishi et al. | 417/213 |
| 7,094,044 | B2 * | 8/2006 | Strueh | 418/268 |

FOREIGN PATENT DOCUMENTS

WO WO 95/08047 9/1994

OTHER PUBLICATIONS

International Search Report, mailed Sep. 4, 2006.

* cited by examiner

*Primary Examiner* — Thomas E Denion
*Assistant Examiner* — Mary A Davis
(74) *Attorney, Agent, or Firm* — Winston & Strawn LLP

(57) ABSTRACT

A vane pump for pumping hydraulic fluid wherein fluid at a pressure intermediate the inlet pressure and the outlet pressure of the pump is supplied to under vane passages of the vanes located in and passing through the rise region of the pump. This assists in preventing damage to the vanes caused by driving the vanes through the protective coating of oil on the wall of the pump chamber when the vanes are travelling through an inlet region of the pump.

22 Claims, 6 Drawing Sheets

VANE PUMP

CROSS-REFERENCE TO RELATED APPLICATIONS

This application is a 371 filing of International Patent Application PCT/AU2006/000623 filed on May 12, 2006.

TECHNICAL FIELD

In one aspect, the present invention relates to an improved vane pump. In another aspect, the present invention relates to an improved hydraulic circuit. In yet another aspect, the present invention relates to a hydraulic machine having improved vane clamping means.

BACKGROUND ART

Hydraulic vane pumps are used to pump hydraulic fluid in many different types of machines for different purposes. Such machines include, for instance, earth moving, industrial and agricultural machines, waste collection vehicles, fishing trawlers, cranes, and vehicle power steering systems.

Hydraulic vane pumps typically have a housing with a chamber formed therein. A rotor is rotatably mounted in the housing. The rotor is typically of generally cylindrical shape and the chamber has a shape such that one or more rise and fall regions are formed between an outer wall of the rotor and an inner wall of the chamber. In the rise regions, a relatively large space opens between the outer wall of the rotor and the inner wall of the chamber. On the leading side of the rise region, there exists a region which is substantially a dwell, although in usual practice there exists a small amount of fall. This is sometimes called a major dwell or major dwell region. The major dwell is followed by a fall region, in which the space between the outer wall of the rotor and the inner wall of the chamber decreases. The rotor normally has a number of slots and moveable vanes are mounted in the slots. As the rotor rotates, centrifugal forces cause the vanes to move to an extended position as they pass through the rise regions. As the vanes travel along the fall regions, the vanes are forced to move to a retracted position by virtue of the rotors contacting the inner wall of the chamber as they move into a region of restricted clearance between the rotor and chamber. Hydraulic fluid lubricates the vanes and the inner wall of the chamber. Outside of the rise, fall and major dwell regions, the space between the outer wall of the rotor and the inner wall of the chamber is small. In practice, this is usually a true dwell of zero vane extension and is sometimes called the minor dwell.

Hydraulic vane pumps are usually coupled to a drive, such as to a rotating output shaft of a motor or an engine and, in the absence of expensive space invasive clutches or other disconnecting means, continue to pump hydraulic fluid as long as the motor or engine continues to operate. A rotor of the pump usually has a rotational speed determined by the rotational speed of the motor or engine.

U.S. Pat. No. 3,421,413 to Adams et al describes a sliding vane pump in which hydraulic pressure is applied to each vane in order to maintain the vanes in optimum engagement with a cam surface that encircles the rotor which carries the vanes. That patent is directed towards ensuring that the vanes remain in optimum contact with the encircling cam.

U.S. Pat. No. 3,586,466 to Erickson describes a rotary hydraulic motor having a slotted rotor and a moveable vane located in each slot. The rotor is journalled in a chamber that defines three circumferentially spaced crescent-shaped pressure chamber sections. The hydraulic motor includes a valve control means and associated passages to be able to selectively control the flow of pressurised fluid to the pressure chamber sections. This allows pressurised fluid to be supplied to one, two or all three pressure chamber sections. When pressurised fluid is delivered to all three pressure chamber sections, low speed, high torque operation occurs. When pressurised fluid is delivered to two pressure chamber sections, higher speed but lower torque operation occurs. When pressurised fluid is delivered to only one pressure chamber section, even higher speed but lower torque operation of the motor occurs.

The hydraulic motor of Erickson also includes an arrangement of passages that allow pressurised fluid to impart radially outward movement to the vanes adjacent inlet passages to the pressurised chamber sections and to impart radially inward movement to the vanes adjacent outlet passages of the pressurised chamber sections. Thus, each vane is fluid pressure urged radially outwardly into sealing engagement with the concavity or concave surface of each pressurised chamber section during initial movement of the vane circumferentially across the pressurised chamber section, the vane being moved radially inwardly by fluid pressure at the circumferentially opposite end of the pressurised chamber section, to reduce the frictional load between each vane and the inner peripheral surface portions of the chamber at areas wherein there is little or no circumferential pressure applied to the vanes (see column 4, lines 55 to 72).

The entire contents of U.S. Pat. Nos. 3,421,413 and 3,586,466 are expressly incorporated herein by cross reference.

In my co-pending International Patent Application No. PCT/AU2004/000951, I describe a hydraulic machine in which the vanes can be selectively retained in a retracted position such that the hydraulic fluid is not worked, and in which the vanes can be selectively allowed to move between the retracted position and the extended position such that the hydraulic fluid is worked by the vanes. That international patent application also describes a number of venting arrangements by which pressurised hydraulic fluid under the vanes can be vented as the vanes move into and through the fall regions. The entire contents of my International Patent Application No. PCT/AU2004/000951 are herein incorporated by cross reference.

One known limit to improving the pressure and speed capability of hydraulic fluid vane pumps is the out-of-balance forces applied to the under-vane regions in the mid quadrant. In this regard, hydraulic vane pumps typically have an inlet located at the start of the rise region (if the pump has more than one rise region, it will have more than one inlet). The inlets supply low pressure hydraulic fluid (for convenience, "hydraulic fluid" will hereinafter be referred to as "oil") to the rise region. As the vanes move the oil through the rise region, into the major dwell and then into the tall region, the oil becomes pressurised. The pressurised oil leaves via outlets associated with each fall region of the pump.

It is also known that, in many hydraulic vane pumps, the under vane region is exposed to oil that has been pressurised to the outlet pressure. This can lead to out of balance forces being applied to the vanes. For example, when the vane is on the pressure (or outlet) quadrant, the vane is exposed to high pressure oil at both an outer tip of the vane and under the vane. Thus, the forces on the vane arising from the oil are in balance. However, in the suction (or inlet) quadrants, the tips of the vanes are exposed to low pressure inlet oil whilst the bottom of the vanes are exposed to high pressure oil. This causes an imbalance of pressure which acts to push the vanes outwardly. This force can exceed the limits of the pump specifications. If this happens, the vanes can be driven through the protective film of oil that should exist between the tips of the vanes and the pump chamber. If this occurs, damage to the vanes can be caused.

There have been some attempts to limit these forces, including:

(a) providing a small vane area over the suction quadrant to which the high pressure oil is directed and full vane area at the discharge outlet. As the force applied by the under-vane oil is a product of the oil pressure multiplied by the area over which that pressure is applied, the force is lower in the suction quadrant;

(b) pin vane arrangements which use a pin inside a separate chamber, to which high pressure oil is directed. This high pressure oil only acts on the small pin, which will typically generate insufficient force to push the vane through the oil film in the suction quadrant.

These methods are all intended to limit the under vane force in the suction quadrant. However, as the areas under the vanes in the suction quadrants to which high pressure outlet oil is directed are reduced to increase the under pressure and speed rating of the pumps, the pumps can be unstable at lower speeds and pressures as the forces are too low to hold the vanes in stable operation.

Another issue that is arising in relation to hydraulic pumps has been caused by the increasing trend to heavy vehicles (either on road or off highway) having a full stand-by system against pump line rupture or pump drive failure. In this system, there is a risk of flooding the apparatus (such as a power steering apparatus) with pressurised hydraulic fluid should the secondary or emergency pump commence operation.

DISCLOSURE OF INVENTION

A first aspect of the present invention is directed towards an improved vane pump that addresses the issue of excess under vane hydraulic fluid (oil) pressure.

According to a first aspect, the present invention provides a vane pump for pumping hydraulic fluid, comprising a body having a chamber, a rotor rotatable within the chamber, the chamber and the rotor being shaped to define one or more rise, fall and dwell regions between walls of the chamber and the rotor, the rotor having a plurality of slots, a plurality of vanes located such that each slot of the rotor has a vane located therein, each vane being moveable between a retracted position and an extended position wherein in the retracted position the vanes do not work the hydraulic fluid and in the extended position the vanes work the hydraulic fluid, an under vane passage extending beneath each said vane, one or more inlets for introducing relatively low pressure hydraulic fluid into the one or more rise regions, one or more outlets for discharging relatively high pressure hydraulic fluid from the one or more fall regions, at least one flow passage for supplying hydraulic fluid at outlet pressure to the under vane passages of the vanes located in the fall region, and intermediate pressure supply means for supplying hydraulic fluid of an intermediate pressure to the under vane passages of the vanes located in and passing through the rise region, said intermediate pressure being lower than the outlet pressure but higher than the inlet pressure of the hydraulic fluid.

In one aspect, the hydraulic fluid of intermediate pressure is provided by taking hydraulic fluid of high pressure from the outlet of the vane pump and passing it through a pressure regulator that lowers the pressure of the hydraulic fluid to an intermediate pressure, and subsequently supplying that intermediate pressure hydraulic fluid to the under vane passages of the vanes located in and passing through the rise region (also referred to herein as the "inlet region").

In another aspect, the hydraulic fluid of intermediate pressure is provided by taking hydraulic fluid of high pressure other than from the outlet of the pump, passing said hydraulic fluid of high pressure through a pressure regulator that lowers the pressure of the hydraulic fluid to an intermediate pressure, and subsequently supplying that hydraulic fluid of intermediate pressure to the under vane passages of the vanes located in and passing through the rise region.

The hydraulic fluid of intermediate pressure may be obtained from a return line in a typical hydraulic circuit. This hydraulic fluid is typically high pressure oil that has passed through other apparatus in the hydraulic circuit (such as a power steering apparatus) and, as a result, is of reduced or intermediate pressure. This oil typically passes through a back pressure valve, and possibly a filter and cooler to a reservoir of hydraulic fluid for return to the hydraulic fluid pump. Preferably, the hydraulic fluid of reduced pressure is taken from a position upstream of a pressure reduction valve.

Alternatively, the source of hydraulic fluid of intermediate pressure may comprise pressurised hydraulic fluid leaving another hydraulic fluid pump. Optionally, this pressurised hydraulic fluid may pass through a pressure regulator in order to reduce its pressure prior to being fed to the under vane passages of the vanes in the rise region of the hydraulic vane pump.

The hydraulic vane pump in accordance with the first aspect of the present invention will typically include a pressure plate at one end of the rotor and a pump body end at the other end of the rotor. One or both of the pressure plate and the pump body end may be provided with a discharge orifice that comes into register with the under vane passages when the vanes are in a discharge quadrant of the pump. Suitably, the discharge orifice is in fluid communication with the outlet of the pump. In this fashion, the hydraulic fluid under the vanes when the vanes are in the discharge quadrant is at a pressure at least equal to the outlet pressure of the pump.

Suitably, one or both of the pressure plate or the pump body end has at least one intermediate pressure hydraulic fluid supply orifice that comes into register with the under vane passages when the vanes pass through an inlet quadrant. The intermediate pressure hydraulic fluid supply orifice is suitably connected to a source of intermediate pressure hydraulic fluid.

Suitably, the discharge orifice that comes into register with the under vane passages is formed in one of the pressure plate or pump body end and the intermediate pressure hydraulic fluid supply orifice is in the other of the pressure plate or pump body end.

The hydraulic vane pump in accordance with the first aspect of the present invention may be a hydraulic vane pump as described with reference to my International Patent Application No. PCT/AU2004/000951, the entire contents of which are incorporated herein by cross reference. The pump described in my International Patent Application No. PCT/AU2004/000951 includes retaining means that can be selectively actuated to retain the vanes in the retracted position. The retaining means can be selectively released in order to allow the vanes to extend to thereby work the hydraulic fluid. Most suitably, the source of intermediate pressure hydraulic fluid is used to activate and/or deactivate the retaining means in this embodiment of the present invention.

A second aspect of the present invention is directed primarily towards a recently emerging trend of providing a full standby system against pump line rupture or pump drive failure.

According to a second aspect, the present invention provides a hydraulic circuit for supplying pressurised hydraulic fluid to an apparatus, the hydraulic circuit including a first vane pump for supplying pressurised hydraulic fluid to an apparatus, a second vane pump of the kind in which the vanes can be selectively retained by retaining means in a retracted position such that the vanes do not work the hydraulic fluid and the vanes can be selectively released so that they can extend to an extended position to work the hydraulic fluid and to supply pressurised hydraulic fluid to the apparatus when the vanes of the second vane pump have been released, and control means for sensing pressurised hydraulic fluid leaving an outlet of the first vane pump, said control means operative to cause the vanes of the second pump to be retained in the retracted position when pressurised hydraulic fluid from the outlet of the first vane pump is sensed, the control means further being operative to release the vanes of the second vane pump such that the vanes can extend and pump hydraulic fluid when the control means senses that the pressure of the hydraulic fluid leaving the outlet of the first vane pump drops below a predetermined pressure.

Preferably, the control means includes a fluid sensing line in fluid communication with the outlet of the first vane pump. The fluid sensing line suitably operates a first valve. When the fluid sensing line provides pressurised fluid to the first valve, the first valve then, either directly or indirectly, causes the vanes of the second vane pump to be retained. Suitably, the first valve, either directly or indirectly, causes hydraulic fluid under pressure to flow to the retaining means to thereby cause the retaining means to move to a retaining position in which the vanes of the second pump are held in the retracted position.

When the fluid sensing line senses a loss of pressure from the outlet of the first vane pump, the first valve operates to, either directly or indirectly, cause the retaining means to move away from the retaining position to thereby allow the vanes of the second vane pump to move from the retracted position to the extended position.

More suitably, when the first valve senses pressurised hydraulic fluid from the outlet of the first vane pump, the first valve sends pressurised hydraulic fluid to a second valve. A second fluid sensing line may connect a spool of the second valve to the first fluid sensing line. When there is pressure in the second fluid sensing line, the spool in the second valve is positioned such that pressurised hydraulic fluid can flow to one or more clamping ports on the second vane pump that activates the retaining means to retain the vanes of the second vane pump in the retracted position. The pressurised hydraulic fluid supplied to the one or more clamping ports may suitably be pressurised hydraulic fluid received from the first valve that has passed through a pressure regulator to thereby reduce its pressure.

When the first fluid sensing line senses that there is no fluid pressure from the outlet of the first vane pump, or that the pressure of hydraulic fluid from the outlet of the first vane pump has dropped below a predetermined pressure, the second valve operates such that fluid flowing to the clamping ports is stopped. This suitably causes the retaining means to move to a position in which the vanes of the second vane pump are free to extend and retract as the rotor of the second vane pump rotates. Even more suitably, a supply of pressurised fluid is provided to under vane passages of the second vane pump when the vane retaining means are released.

In the second aspect of the present invention, the second vane pump is suitably as described with reference to my International Patent Application No. PCT/AU2004/000951.

In a third aspect, the present invention provides a hydraulic machine comprising a body having a chamber, a rotor rotatable within the chamber, the chamber and the rotor being shaped to define one or more rise, fall and dwell regions between the walls of the chamber and the rotor, the rotor having a plurality of slots, a plurality of vanes located such that each slot of the rotor has a vane located therein, each vane being moveable between a retracted position and an extended position wherein in the retracted position the vane is unable to work the hydraulic fluid introduced into the chamber and in the extended position the vane is able to work the hydraulic fluid introduced into the chamber, an inlet for introducing hydraulic fluid into the chamber, an outlet through which hydraulic fluid leaves the chamber, and vane retaining means being selectively actuable to retain the vanes in the retracted position and selectively actuable to release the vanes and allow the vanes to move from the retracted position to the extended position, wherein the vane retaining means comprises moveable engagement means to move between a retaining position and a non-retaining position, and moveable actuating means moveable between a first position and a second position wherein the moveable engagement means are forced to move from a non-retaining position to a retaining position by movement of the moveable actuation means between the first position and the second position.

The moveable actuation means may be of any suitable size, shape and construction. Suitably, each moveable actuation means comprises a spool having a region of relatively large cross sectional area and a region of relatively small cross sectional area with the regions of relatively large cross sectional area and relatively small cross sectional area being connected by a ramped or sloping portion. The moveable engagement means can move to the non-retaining position when the relatively small cross sectional region of the moveable actuation means contacts the moveable engagement means. The moveable engagement means is forced to move to the retaining position when the relatively larger cross sectional area region contacts the moveable engagement means.

Preferably, pressurised hydraulic fluid (oil) is used to move the moveable actuation means in at least one direction. Preferably, a spring causes the moveable actuation means to move in the opposite direction once pressurised hydraulic fluid has been removed from the moveable actuation means. Suitably, the moveable actuation means moves between the first position (in which the vanes are not retained) and the second position (in which the vanes are retained) by virtue of applied pressurised hydraulic fluid.

The spool suitably has a region of relatively smaller diameter and a region of relatively larger diameter, with the two regions being connected by a generally frusto conical region having sloped or ramped side walls.

The moveable engagement means may be of any suitable size, shape and construction. Each moveable engagement means may comprise, for instance, at least one ball, pin, plate or other type of retaining member which detents into a hole formed in a side of the vane. The moveable engagement means suitably comprises two small balls, more suitably one small ball, which detent into a hole formed in a side of the vane.

BEST MODES FOR CARRYING OUT THE INVENTION

It will be appreciated that the attached drawings have been provided for the purposes of illustrating preferred embodiments of the various aspect of the present invention. Thus, it will be understood that the present invention should not be considered to be limited to the features as shown in the attached drawings.

Figure 1:
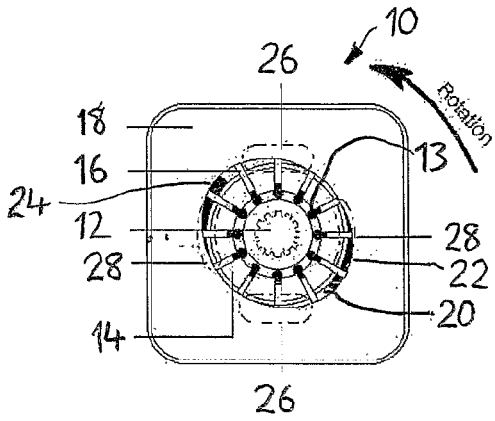
FIGS. 1 and 2 are schematic vane pump layouts showing the inlet (suction) and outlet (discharge) quadrants of a prior art vane pump.
Figure 2:
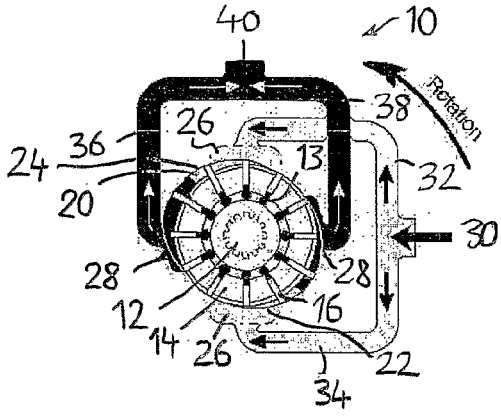

FIGS. 1 and 2 show schematic drawings of vane pump layouts showing inlet 26 (suction) and outlet 28 (discharge) quadrants of a prior art hydraulic vane pump 10. FIG. 1 shows a rotor 14 and housing 18 whereas FIG. 2 shows the rotor 14 with inlet 32, 34 and outlet 36, 38 flow passages. The vane pump 10 shown in FIGS. 1 and 2 has a drive shaft 12 that is mounted via a spline to the rotor 14. The rotor 14 has a plurality of slots, each of which carries a vane 16. An under vane passage 13 extends beneath each vane 16.

The rotor 12 is generally cylindrical in shape. It is mounted within a chamber 20 of the housing 18. The chamber 20 has two lobes 22, 24. The space between an outer wall of the rotor 14 and an inner wall of the chamber 20 in the respective lobes 22, 24 defines a region having a rise, a major dwell and a fall region. The inlet quadrants 26 are positioned in the rise region of the lobes 22, 24. The outlet quadrants 28 are positioned in the fall regions of the lobes 22, 24. As shown in FIG. 2, low pressure oil ("oil" is also referred to as hydraulic fluid), for example from a reservoir of oil, travels via flow passages 32 and 34 into the inlets 26. Similarly, the outlets 28 collect oil under pressure. The pressurised oil is transferred via flow passages 36 and 38 and sent via combined outlet 40 to an apparatus, such as a power steering apparatus or the like.

When a vane 16 of the rotor 14 is in an outlet quadrant 28, the pressurised oil acts on a tip of the vane 16 in the outlet quadrant 28 as well as on a bottom of the vane 16 in the outlet quadrant 28. This occurs because the under vane passages 13 of the rotor 14 are typically placed in fluid communication with the outlets 28. Thus, in the outlet quadrants 28, the forces acting on the tip of the vane 16 and under the vane 16 are generally in balance. However, in the suction quadrants (inlet quadrants) 26, the tips of the vanes 16 are exposed to the low pressure oil from the inlet passages 32, 34 whilst the under vane passages 13 are exposed to high pressure oil. The high pressure oil in the under vane passages 13 assist in driving the vanes 16 from a retracted to an extended position as the rotor rotates through the rise region. However, if the forces acting on the under vane areas exceeds the limit of the pump specifications, the tips of the vanes 16 can be forced through the oil film lining the inner wall of the chamber 20. If this happens, damage to the vanes 16 can occur.

Figure 3:
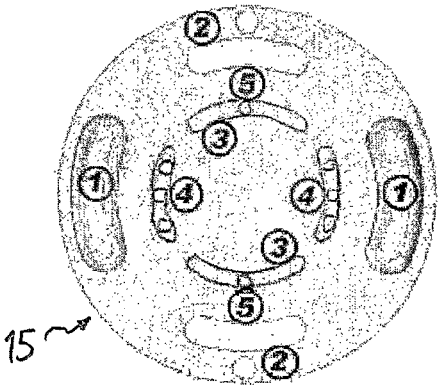
FIG. 3 is a schematic diagram of a pressure plate used in a prior art hydraulic vane pump.

FIG. 3 shows a pressure plate 15 of a prior art hydraulic vane pump. In FIG. 3, the inlet quadrants are represented by reference numeral 1 and the outlet quadrants are represented by reference numeral 2. Chambers 3 and 4 are connected under the vanes to the pump outlet. Hence, the pressure of the oil under the vanes is basically equal to the outlet pressure of the pump. Oil is discharged out chamber 2 and orifice 5 as the vanes retract. Pressurised oil is fed under the vanes in the suction quadrant 1 as the vanes extend. This pressurised oil is fed via orifices 4. Consequently, high pressure oil is directed under the vanes in the suction quadrant and low pressure oil is directed onto the tips of the vanes in the suction quadrant.

Figure 4:
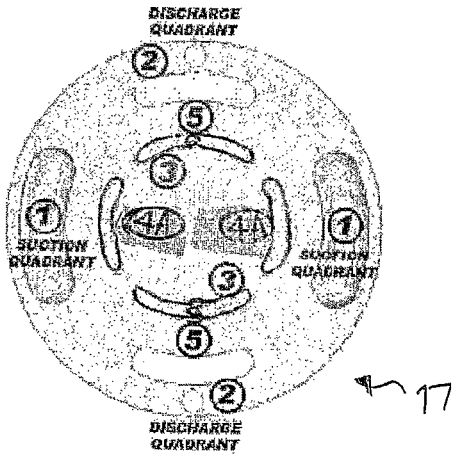
FIG. 4 is a schematic diagram of a pressure plate used in a hydraulic vane pump in accordance with an embodiment of the first aspect of the present invention.

FIG. 4 shows a modified pressure plate 17 for use in an embodiment of the present invention. In the pressure plate 17 shown in FIG. 4, features that are common with the pressure plate 15 shown in FIG. 3 are denoted by like reference numerals. In the pressure plate 17 of FIG. 4, rather than having the orifices 4 shown in FIG. 3 that direct outlet pressure pressurised oil to the under vane passages in the suction quadrant, chambers 4*a* deliver oil of intermediate pressure to the under vane passages as the respective vanes pass through the suction quadrant 1. This is achieved by excluding the connections to the pump outlet and feeding these quadrants by a regulated lower pressure source of oil. In this fashion, the likelihood of excessive force being applied to the under vane passages, which could cause damage to the vanes, is reduced or avoided.

The source of intermediate pressurised oil may include any of the following:

(a) a pressure reduced oil stream taken from the outlet of another hydraulic vane pump;

(b) a pressure reduced oil taken from the outlet of the same hydraulic vane pump;

(c) a lower pressure oil stream being returned to the oil reservoir of a typical hydraulic circuit.

Figure 5:
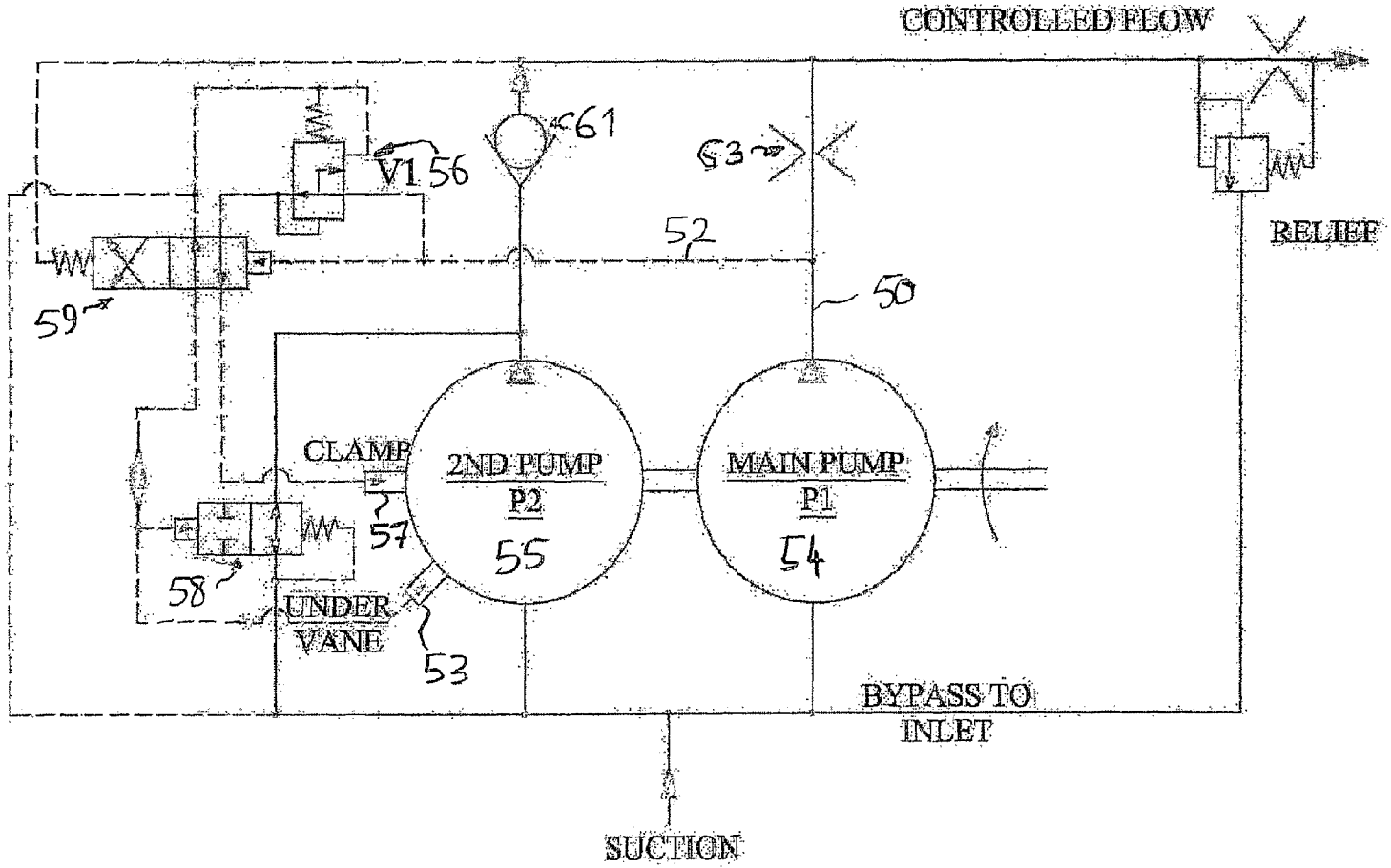
FIG. 5 is a schematic diagram of a hydraulic circuit that can be used with a hydraulic vane pump in accordance with an embodiment of the first aspect of the present invention.

FIG. 5 shows a hydraulic circuit including a main pump P1 54, a second vane pump P2 55, and an arrangement for providing pressurised oil of intermediate pressure to under vane passages 53 of the second pump P2. The main pump P1 54 may be a completely separate pump to second pump P2 55. Alternatively, a single housing may be provided having a first rotor for pump P1 54 and a second rotor for pump P2 55. The main pump P1 54 has an outlet line 50 through which fluid at outlet pressure leaves the pump P1 54. A relieving valve V1 56 is provided, which relieving valve 56 receives pressurised oil from sensing line 52. This pressurised oil goes through pressure relieving valve V1 56, after which the pressurised oil from line 52 is at a lower, intermediate pressure. This oil may then be sent to the under vane passages 53.

The second pump P2 55 is suitably of the type as described in my co-pending International Patent Application No. PCT/AU2004/000951. Such hydraulic vane pumps 55 allow the selective clamping and retaining of the vanes in the retracted position. Suitably, pressurised oil of intermediate pressure from valve V1 56 is also used to actuate the clamping or retaining means 57.

The hydraulic circuit shown in FIG. 5 includes an outlet to inlet phasing valve 58, a pressure balanced sequencing valve 59 responsive to the pressure sensed from line 50, a check valve 61 and a flow orifice 63 for sequence when flow increases to, say, 90% of said flow sequence valve which unloads pump P2 55. The circuit shown in FIG. 5 is generally similar to that shown in FIG. 44 of my co-pending International Patent Application No. PCT/AU2004/000951, but with relief valve V1 56 provided such that pressurised oil of intermediate pressure is used to operate the clamping means 57 and to be supplied to the under vane passages 53.

Figure 6:
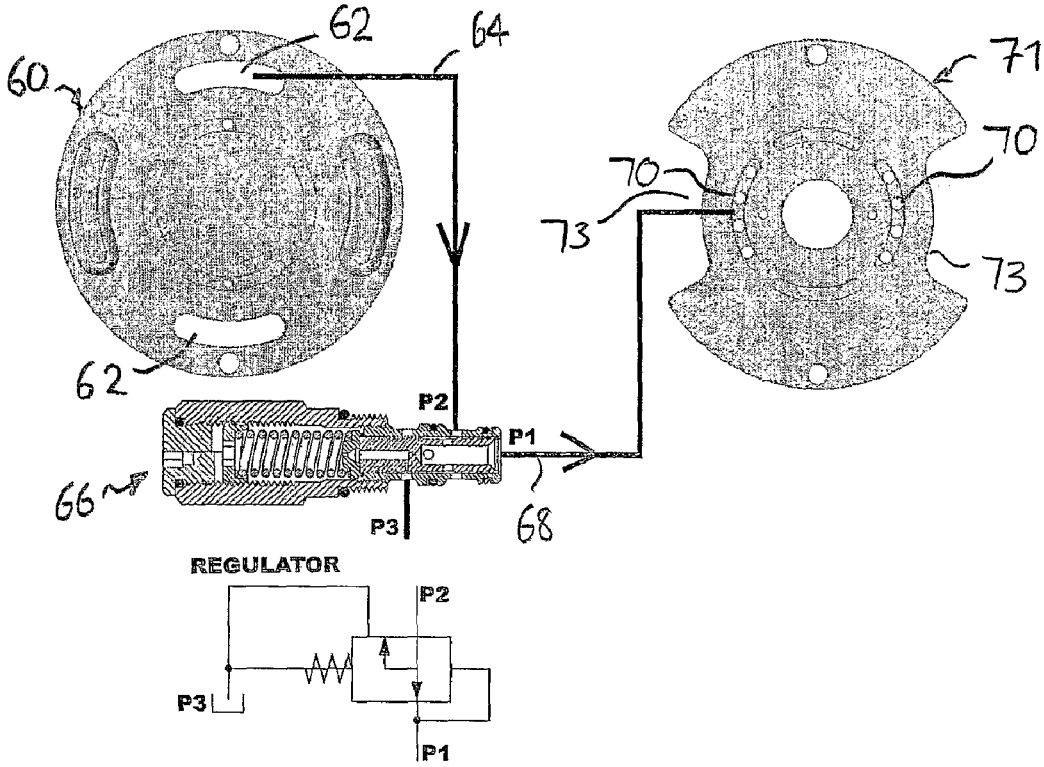
FIG. 6 is a schematic diagram showing one possible way of providing hydraulic oil of intermediate pressure.

FIG. 6 shows an alternative embodiment for supplying pressurised oil of intermediate pressure to the under vane passages. In the schematic diagram of FIG. 6, the pressure plate 60 has outlets 62 formed therein. Outlets 62 are connected to outlet flow passages (not shown). A bleed line 64 takes pressurised oil at outlet pressure from the outlet 62 or from the flow passages connected to the outlet 62. The pressurised oil from line 64 passes through a flow regulator 66. When oil is desired to be supplied to the under vane passages in the inlet quadrant 73, flow regulator 66 provides pressurised oil 68 of intermediate pressure to orifices 70 formed in the pump body end 71, which orifices 70 come into register with the under vane passages as the vanes pass through the suction quadrants 73.

Regulator 66 includes a pressure drop from outlet pressure P2 to intermediate pressure P1 caused by the pressurised oil passing through appropriate flow restrictions.

Figure 7:
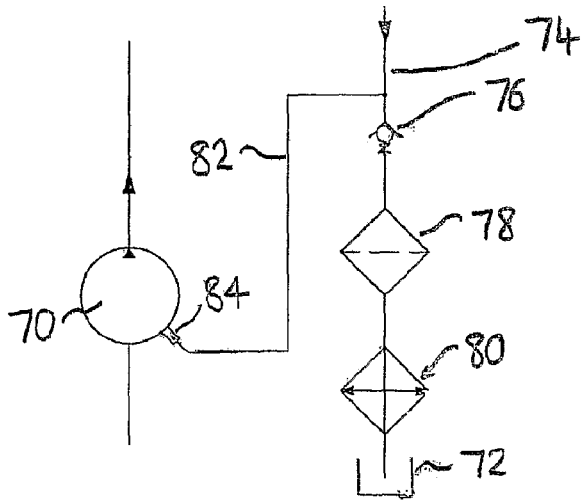
FIG. 7 is another schematic diagram showing an alternative way of providing hydraulic oil of intermediate pressure.

FIG. 7 shows a further alternative for providing pressurised oil of intermediate pressure to under vane passages of vanes passing through the suction quadrants. In FIG. 7, the pump 70 receives oil from a reservoir 72. The pressurised oil leaving the pump 70 goes to an apparatus that is actuated by the pressurised oil, such as a power steering apparatus. The oil, then at lower pressure (due to pressure drop through the power steering apparatus) is then returned to the reservoir 72. The typical oil return circuit includes a flow pipe 74 that passes through a back pressure valve 76 to reduce the pressure further, a filter 78 and a cooler 80. In accordance with an embodiment of the present invention, a further conduit 82 is provided to divert some of the oil from line 74 to the under vane supply suction quadrants 84.

Figure 8:
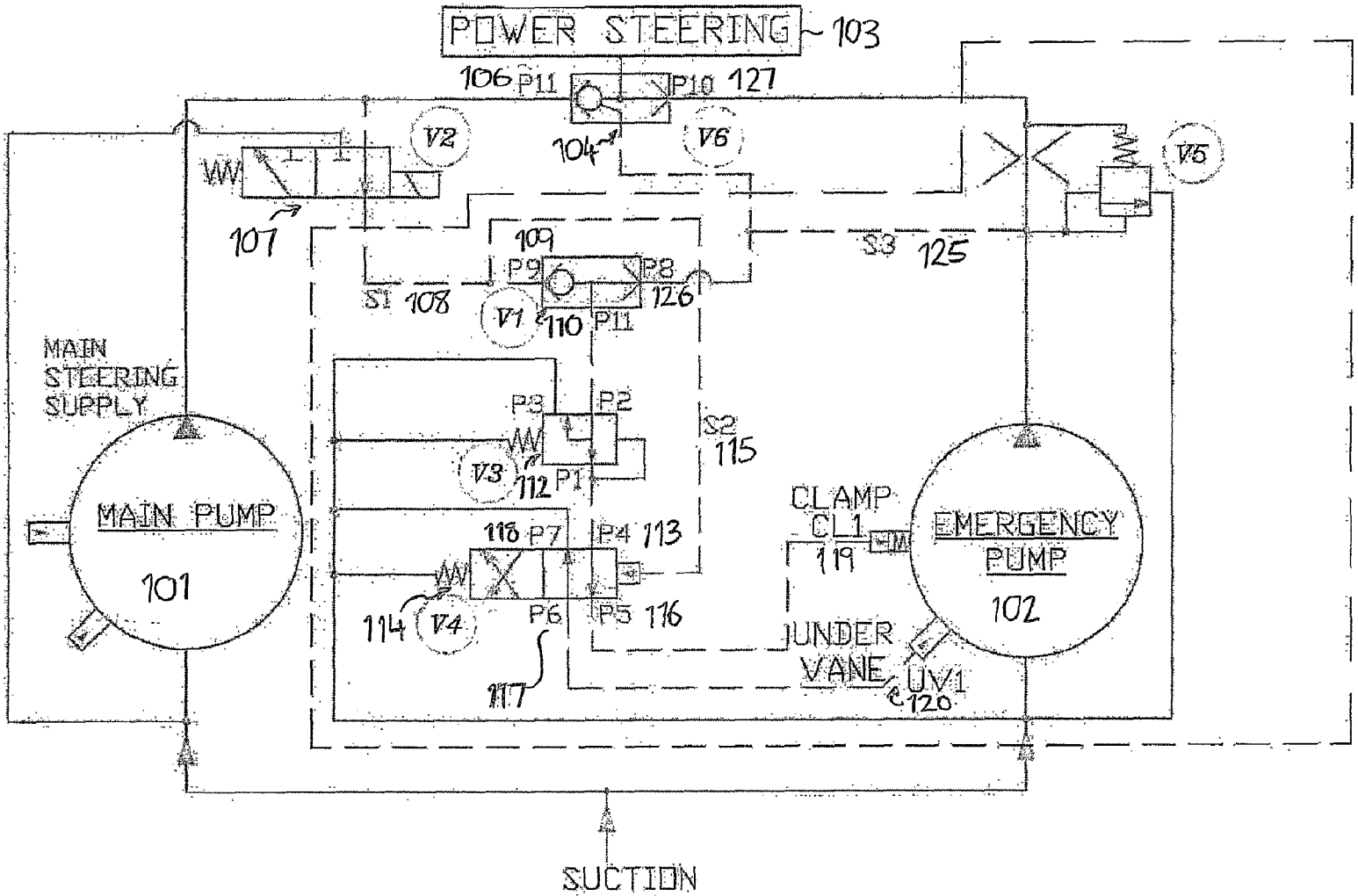
FIG. 8 is a flow diagram of a hydraulic circuit in accordance with an embodiment of the second aspect of the present invention.

FIG. 8 shows a hydraulic circuit in accordance with an embodiment of the second aspect of the present invention. FIG. 8 may be used, for example, in situations where a main pump is provided with a full standby emergency system to guard against pump line rupture or pump drive failure. The hydraulic circuit includes a main pump 101 and an emergency pump 102. Again, emergency pump 102 may be a hydraulic vane pump as described in my co-pending International Patent Application No. PCT/AU2004/000951. The vanes of emergency pump 102 can be selectively retained in the retracted position.

In FIG. 8, the main output pump 101 supplies oil for power steering via shuttle valve V6 104 and port P11 106. Valve V2 107 is an optional operator controlled pump to allow for manual selection of the emergency pump 102.

Shuttle valve V6 104 may have a pilot setting to close port P11 106 to ensure that the power steering apparatus 103 is not flooded with twice the recommended oil flow when the emergency pump 102 is in operation.

In normal operation, signal line S1 108 supplies oil (at outlet pressure from the main pump 101) via P9-V1 109, 110 through P11 106 to pressure regulator V3 112 to P4 113 on valve V4 114. Signal line S2 115 is connected to valve V4 114 to drive the spool of valve V4 114 into the position where P4 113 is connected to P5 116 and P6 117 to P7 118, which is at tank (reservoir) pressure.

When P4 113 is connected to P5 116, the vanes of the emergency pump 102 are clamped via clamp port CL1 119 and the under vane connection UV1 120 drains via P6 117 to P7 118. In this fashion, as the vanes are retracted and retained in the clamped position, any excess under vane pressure can be vented to tank.

Should valve V2 107 be armed or pump 101 fail, then the pressure signal in signal line S1 108 is lost. The spring in valve V4 114 then pilots P4 113 to P6 117 and P5 116 to P7 118. This enables the vane retaining means to be deactivated, such as by the action of springs in the clamping means. Consequently, the vanes in emergency pump 102 can extend and retract and pump 102 then acts to pump hydraulic oil.

Signal line S3 125, via P8-P4 126, 113, pressure regulator V3 112 and P4 113 to P6 117, supplies under vane pressure to the suction quadrants only.

Pump operations are via P10 127 in shuttle valve V6 104 for standby operation.

The hydraulic circuit shown in FIG. 8 operates emergency pump 102 in standby mode in which the vanes are retained in the retracted position such that pump 102 does not pump fluid when the main pump 101 is functioning properly. If main pump 101 fails or if valve V2 107 is operated for manual selection of pump 102, the intermediate pressurised oil provided to clamp port CL1 119 is removed and instead is provided to under vane passages via port UV1 120. This under vane passage oil of intermediate pressure assists in moving the vanes from the retracted position to the extended position as the vanes move into the rise region. The pressure applied by the pressurised oil of intermediate pressure in the under vane passages is sufficiently high to stabilise operation of the vanes but not so high as to drive the vanes through the protective film of oil on the inner wall of the chamber. This minimises the risk of damage to the tips of the vanes.

Figure 9:
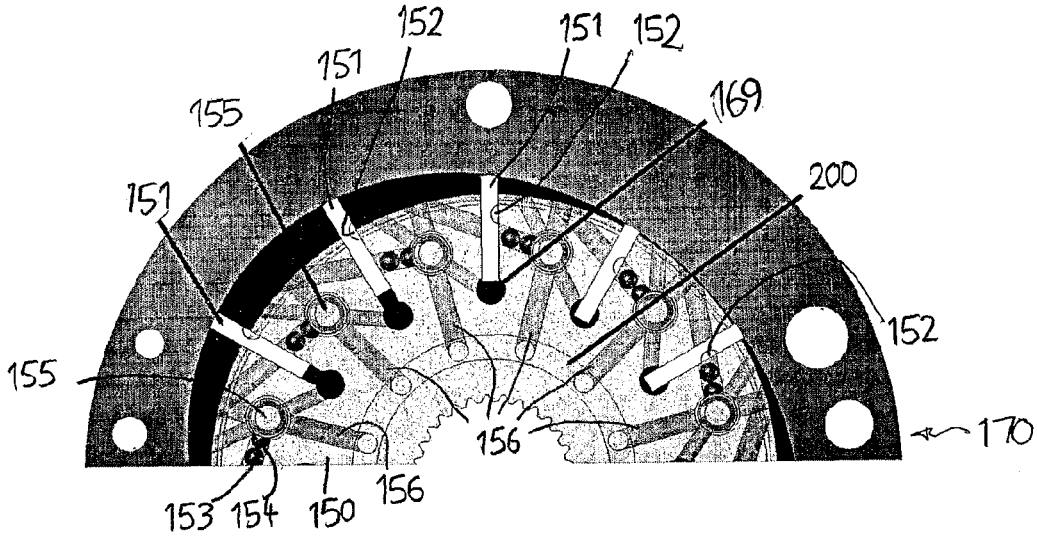
FIG. 9 is a schematic diagram of part of a hydraulic vane pump in accordance with an embodiment of the third aspect of the present invention.
Figure 10:
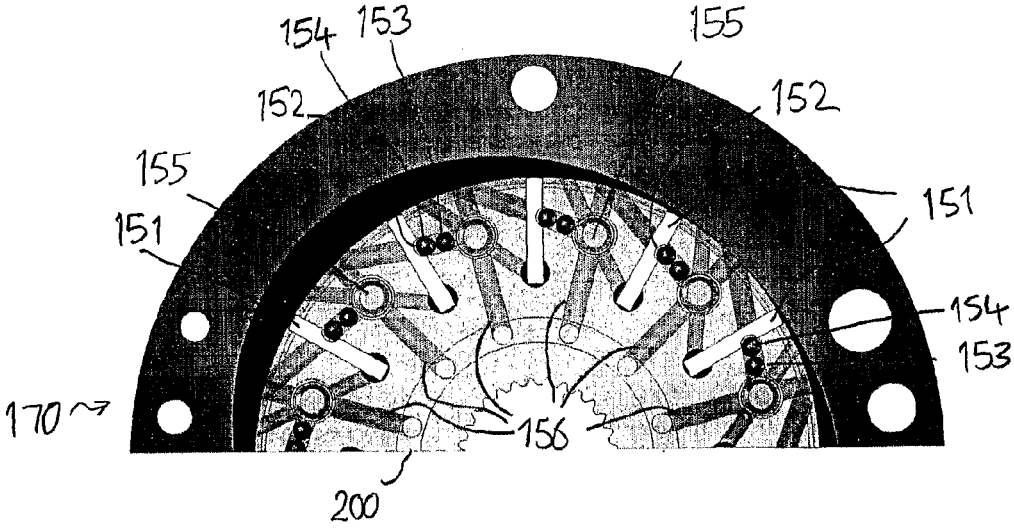
FIG. 10 shows the hydraulic vane pump of FIG. 9 but with vanes of the clamp being in a retracted and clamped mode.

FIGS. 9 and 10 show a view of a hydraulic vane pump 170 in accordance with an embodiment of the third aspect of the present invention. In FIGS. 9 and 10 the rotor 150 is shown as though it was transparent in order to disclose the various galleries of the rotor 150. In FIG. 9, the pump 170 is operating in the unclamped mode in which the vanes 151 are free to extend and retract as the rotor 150 rotates within the housing. An under vane passage 169 extends beneath each vane 151.

Each of the vanes 151 includes a cavity or hole 152 formed in a side wall thereof. Each clamping mechanism comprises two small balls 153, 154 that are in engagement with a spool 155. Spool 155 will be described in greater detail with reference to FIG. 11. Spool 155 is in fluid communication via appropriate galleries with pressurised oil. These galleries are shown at 156.

Figure 11:
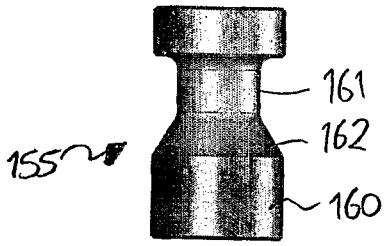
FIG. 11 shows a detent spool suitable for use in the hydraulic pump shown in FIGS. 9 and 10.

As seen in FIG. 11, the spool 155 includes a region 160 of relatively large diameter, a region 161 of relatively smaller diameter and a frusto-conical region 162 therebetween. Each spool 155 is mounted in an appropriate gallery in the rotor 150 together with a spring (not shown).

When the pump 170 is operating normally and the vanes 151 are unclamped (or not retained), the spools 155 are retracted, meaning that there is no force applied to the balls 153, 154. In the retracted position, ball 153 rests within the spool region 161 of smaller diameter. This provides sufficient clearance such that ball 154 is not pushed into contact with the side of the vanes 151 by way of intermediate ball 153.

When the pump is clamped (i.e. when the vanes are retained in the retracted position), as shown in FIG. 10, a positive pressure signal comes from the pressure plate through annular passage 200 and via galleries 156. This acts on the spools 155 and causes the spool 155 to move (in a generally longitudinal direction) and compress the spring such that the region 160 of relatively large diameter comes into contact with ball 154. This pushes the balls 153, 154 towards the vanes 151 such that one of the balls 154 moves into the hole or cavity 152 formed in the side of the vane 151 to thereby retain the vane 151 in the retracted position (see FIG. 10). In the absence of a positive pressure signal, the spring moves the spool region 161 of relatively smaller diameter back into engagement with the ball 154.

Figure 12:
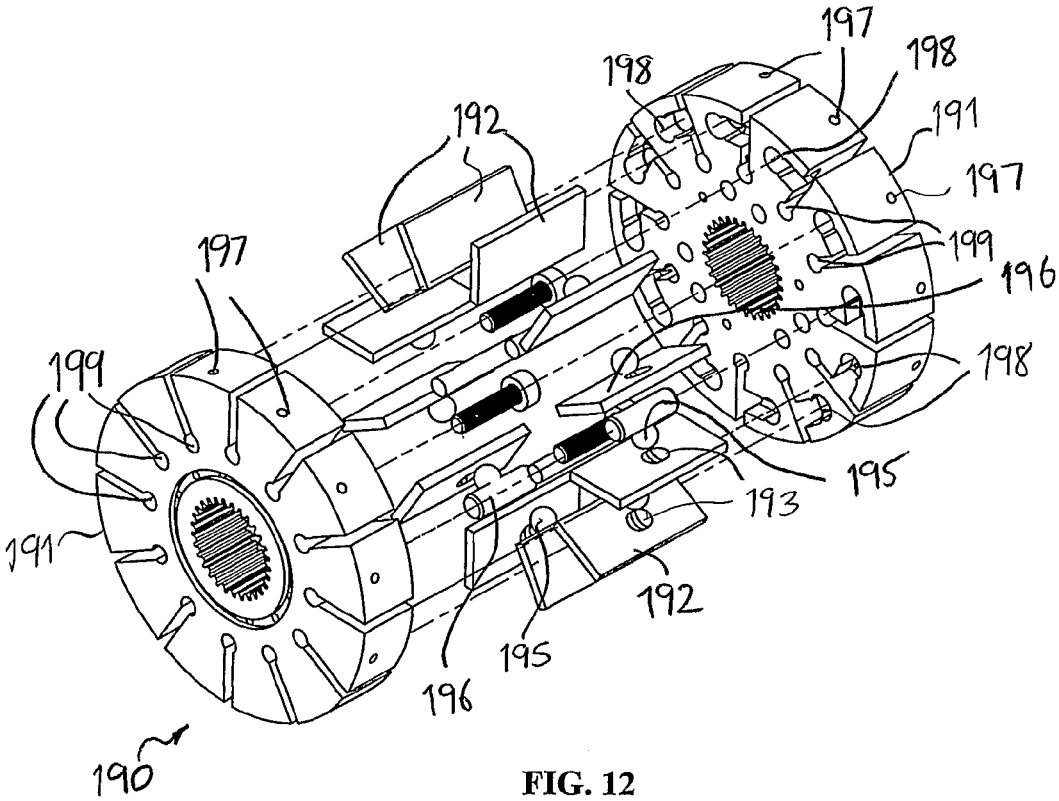
FIG. 12 is an exploded view of part of a hydraulic vane pump in accordance with another embodiment of the third aspect of the present invention.

FIG. 12 shows a view of a hydraulic vane pump 190 in accordance with another embodiment of the third aspect of the present invention. The pump 190 is essentially the same as pump 170 in that it has a rotor 191, vanes 192 having cavities 193 in the side walls thereof, and a clamping mechanism comprising a spool 196, one ball 195 (instead of two) and a spring.

Spool 196 has substantially the same shape as spool 155. Spool 196 is in fluid communication with pressurised oil via galleries 197. Each spool 196 is slidably mounted in a gallery 198 in the rotor 191 together with a spring. An under vane passage extends beneath each vane 192.

When the pump 190 is operating normally and the vanes 192 are unclamped, the spools 196 are retracted, meaning that there is no force applied to the balls 195. In the retracted position, ball 195 rests within the spool 196 region of smaller diameter. When the pump 190 is clamped, a positive pressure signal comes from the pressure plate via galleries 197. This acts on the spools 196 and causes the spool 196 to compress the spring and to laterally force the ball 195 into the cavity 193 formed in the side of the vane 192, to thereby retain the vane 192 in the retracted position. In the absence of a positive pressure signal, the spring moves the spool 196 region of relatively smaller diameter back into engagement with the ball 195.

Those skilled in the art will appreciate that the present invention may be susceptible to variations and modification other then those specifically described. It is to be understood that the present invention encompasses all such variations and modifications that fall within its spirit and scope.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

The invention claimed is:

1. A vane pump for pumping hydraulic fluid, comprising a body having a chamber, a rotor rotatable within the chamber, the chamber and the rotor being shaped to define one or more rise, fall and dwell regions between walls of the chamber and the rotor, the rotor having a plurality of slots, a plurality of vanes located such that each slot of the rotor has a vane located therein, each of the vanes being moveable between a retracted position and an extended position wherein in the retracted position the vanes do not work the hydraulic fluid and in the extended position the vanes work the hydraulic fluid, an under vane passage extending beneath each of the vanes, one or more inlets for introducing relatively low pressure hydraulic fluid into the one or more rise regions, one or more outlets for discharging relatively high pressure hydraulic fluid from the one or more fall regions, at least one flow passage for supplying hydraulic fluid at outlet pressure to the under vane passages of the vanes located in the fall region, and intermediate pressure supply means for supplying hydraulic fluid of an intermediate pressure to the under vane passages of the vanes located in and passing through the rise region, wherein the intermediate pressure is lower than the outlet pressure but higher than the inlet pressure of the hydraulic fluid.

2. The vane pump of claim 1, wherein the intermediate pressure supply means includes means for taking hydraulic fluid of high pressure from the outlet of the vane pump, passing the hydraulic fluid of high pressure through a pressure regulator that lowers the pressure of the hydraulic fluid to the intermediate pressure, and supplying that hydraulic fluid of the intermediate pressure to the under vane passages of the vanes located in and passing through the rise region.

3. The vane pump of claim 1, wherein the intermediate pressure supply means includes means for taking hydraulic fluid of high pressure other than from the outlet of the pump, passing the hydraulic fluid of high pressure through a pressure regulator that lowers the pressure of the hydraulic fluid to the intermediate pressure, and supplying that hydraulic fluid of the intermediate pressure to the under vane passages of the vanes located in and passing through the rise region.

4. The vane pump of claim 3, wherein the hydraulic fluid of high pressure is hydraulic fluid that has been worked by another hydraulic pump.

5. The vane pump of claim 1, wherein the intermediate pressure supply means includes means for taking hydraulic fluid of the intermediate pressure, and supplying that hydraulic fluid of the intermediate pressure to the under vane passages of the vanes located in and passing through the rise region.

6. The vane pump of claim 5, wherein the hydraulic fluid of intermediate pressure is taken from a return line in a hydraulic circuit.

7. The vane pump of claim 5, wherein the hydraulic fluid of intermediate pressure is hydraulic fluid that has been worked by another hydraulic pump.

8. The vane pump of claim 1, which further comprises a pressure plate at one end of the rotor and a pump body end at an opposing end of the rotor, the at least one flow passage comprises a discharge orifice in one or both of the pressure plate and the pump body end that is in fluid communication with the outlet of the pump and which comes into register with the under vane passages of the vanes that are in a discharge quadrant of the pump.

9. The vane pump of claim 8, wherein the intermediate pressure supply means includes and at least one intermediate pressure hydraulic fluid supply orifice in one or both of the pressure plate or the pump body end that comes into register with the under vane passages of the vanes passing through an inlet quadrant of the pump, and the intermediate pressure hydraulic fluid supply orifice is connected to a source of intermediate pressure hydraulic fluid.

10. The vane pump of claim 9, wherein the discharge orifice that comes into register with the under vane passages is formed in one of the pressure plate or pump body end and the intermediate pressure hydraulic fluid supply orifice is in the other of the pressure plate or pump body end.

11. The vane pump of claim 10, which further comprises retaining means that can be selectively actuated to retain the vanes in the retracted position, and the source of intermediate pressure hydraulic fluid is used to activate and/or deactivate the retaining means.

12. A hydraulic circuit for supplying pressurized hydraulic fluid to an apparatus, the hydraulic circuit including a first vane pump for supplying pressurized hydraulic fluid to the apparatus, a second vane pump according to claim 1 wherein the vanes can be selectively retained by retaining means in a retracted position such that the vanes do not work the hydraulic fluid and the vanes can be selectively released so that they can extend to an extended position to work the hydraulic fluid and to supply pressurized hydraulic fluid to the apparatus when the vanes of the second vane pump have been released, and control means for sensing pressurized hydraulic fluid leaving an outlet of the first vane pump, said control means operative to cause the vanes of the second pump to be retained in the retracted position when pressurized hydraulic fluid from the outlet of the first vane pump is sensed, the control means further being operative to release the vanes of the second vane pump such that the vanes can extend and pump hydraulic fluid when the control means senses that the pressure of the hydraulic fluid leaving the outlet of the first vane pump drops below a predetermined pressure.

13. The hydraulic circuit of claim 12, wherein the control means includes a fluid sensing line in fluid communication with the outlet of the first vane pump and a first valve operated by the fluid sensing line, wherein when the fluid sensing line provides pressurized fluid to the first valve, the first valve causes hydraulic fluid under pressure to flow to the retaining means to thereby cause the retaining means to move to a retaining position in which the vanes of the second pump are held in the retracted position.

14. The hydraulic circuit of claim 13, wherein when the fluid sensing line senses a loss of pressure from the outlet of the first vane pump, the first valve operates to cause the retaining means to move away from the retaining position to thereby allow the vanes of the second vane pump to move from the retracted position to the extended position.

15. The hydraulic circuit of claim 14, wherein the control means further includes a second valve and a second fluid sensing line connecting a spool of the second valve to the first fluid sensing line, wherein when the first valve senses pressurized hydraulic fluid from the outlet of the first vane pump, the first valve sends pressurized hydraulic fluid to the second valve, and when there is pressure in the second fluid sensing line, the spool of the second valve is positioned such that pressurized hydraulic fluid can flow to one or more clamping ports on the second vane pump that activates the retaining means to retain the vanes of the second vane pump in the retracted position.

16. The hydraulic circuit of claim 15, wherein the pressurized hydraulic fluid supplied to the one or more clamping ports is pressurized hydraulic fluid received from the first valve that has passed through a pressure regulator to thereby reduce its pressure.

17. The hydraulic circuit of claim 15, wherein when the first fluid sensing line senses that there is no fluid pressure from the outlet of the first vane pump, or that the pressure of hydraulic fluid from the outlet of the first vane pump has dropped below a predetermined pressure, the second valve operates such that fluid flowing to the clamping ports is stopped, thereby causing the retaining means to move to a position in which the vanes of the second vane pump are free to extend and retract as the rotor of the second vane pump rotates.

18. The hydraulic circuit of claim 17, wherein a supply of pressurized fluid is provided to under vane passages of the second vane pump when the vane retaining means is released.

19. A hydraulic machine comprising the vane pump of claim 1, wherein in the retracted position the vanes are unable to work the hydraulic fluid introduced into the chamber and in the extended position the vanes are able to work the hydraulic fluid introduced into the chamber, and vane retaining means being selectively actuable to retain the vanes in the retracted position and selectively actuable to release the vanes and allow the vanes to move from the retracted position to the extended position, wherein the vane retaining means comprises moveable engagement means to move between a retaining position and a non-retaining position, and moveable actuating means moveable between a first position and a second position wherein the moveable engagement means are forced to move from a non-retaining position to a retaining position by movement of the moveable actuation means between the first position and the second position.

20. The hydraulic machine of claim 19, wherein the moveable actuation means comprises a spool having a region of relatively large cross sectional area and a region of relatively small cross sectional area with the regions of relatively large cross sectional area and relatively small cross sectional area being connected by a ramped or sloping portion, wherein the moveable engagement means moves to the non-retaining position when the relatively small cross sectional region of the moveable actuation means contacts the moveable engagement means, and the moveable engagement means is forced to move to the retaining position when the relatively larger cross sectional area region contacts the moveable engagement means.

21. The hydraulic machine of claim 20, wherein pressurized hydraulic fluid and a spring are used to move the moveable actuation means between the first and second positions, wherein the pressurized hydraulic fluid moves the moveable actuation means in a first direction and the spring causes the moveable actuation means to move in a second direction opposite to the first direction once pressurized hydraulic fluid has been removed from the moveable actuation means.

22. The hydraulic machine of claim 21, wherein the moveable engagement means comprises at least one ball which detents into a hole formed in a side of the vane.

* * * * *